US005341750A

United States Patent [19]

Fuchs

[11] Patent Number: 5,341,750

[45] Date of Patent: Aug. 30, 1994

[54] EXTENDABLE TABLE

[75] Inventor: Mike M. Fuchs, Thornhill, Canada

[73] Assignee: Eurocollection Canada Ltd., Brampton, Canada

[21] Appl. No.: 56,398

[22] Filed: May 4, 1993

[51] Int. Cl.[5] ..... A47B 1/00

[52] U.S. Cl. ..... 108/64; 108/66

[58] Field of Search ..... 108/64, 66, 69, 83; 312/257.1, 241

[56] References Cited

U.S. PATENT DOCUMENTS

| | | | |
|---|---|---|---|
| 1,320,215 | 10/1919 | Field | 108/64 |
| 2,705,179 | 3/1955 | Hodgin | 108/64 |
| 3,714,906 | 2/1973 | Finestone | 108/64 |
| 5,146,855 | 9/1992 | Morgan | 108/64 |

FOREIGN PATENT DOCUMENTS

| | | | |
|---|---|---|---|
| 82329 | 11/1956 | Denmark | 108/64 |
| 2333331 | 1/1975 | Fed. Rep. of Germany | 108/64 |

*Primary Examiner*—Jose V. Chen

[57] ABSTRACT

An extendable table includes an insert which is fitted with a pair of tables each of which has releasable leg connectors. The insert includes attachment members for attaching to the tables at their respective leg connectors and the insert includes its own releasable leg connectors for receiving legs removed from the leg connectors of the tables to be fitted in the leg connectors of the insert. The overall arrangement is particularly adapted for use with outdoor resin patio furniture.

3 Claims, 2 Drawing Sheets

EXTENDABLE TABLE

FIELD OF THE INVENTION

The present invention relates to an extendable table design and, in particular, a table leaf and a unique method of attaching that table leaf to two tables connected to one another through the leaf.

BACKGROUND OF THE INVENTION

In a conventional extendable table, i.e. a table including removable leafs, the table is provided with underside tracks along which the table parts slide and which provide support for the leafs when they are inserted in the table.

In any extendable table design, the tracks limit the length to which the table can be extended. In an outdoor patio table, which is typically made of a resin such as vinyl, the track is made of aluminum which does not weather as well as the resin and which adds substantially to the cost of the table.

U.S. Pat. Nos. 5,146,855 and 3,714,906 show specific table designs where a leaf is removably trapped between two tables separated by the leaf. The leaf is contoured to mate with the edge of the tables.

In each of the above Patents, a separate structure is required for supporting the leaf which both complicates and adds to the cost of the table extension.

SUMMARY OF THE INVENTION

The present invention provides a simple cost efficient extendable table assembly. The assembly is based on an insert which is fitted with a pair of tables each having legs secured to the tables by releasable leg connectors. The insert itself includes attachment means for attaching to the tables at their respective leg connectors with the legs removed and the insert includes its own releasable leg connectors for receiving the legs removed from the leg connectors of the tables and fitted into the leg connectors of the insert.

With the above arrangement, no additional legs other than those already provided in the tables themselves are required. These legs, rather than anything in the way of track, provide support for both the insert as well as the tables at opposite ends of the insert.

BRIEF DESCRIPTION OF THE DRAWINGS

The above, as well as other advantages and features of the present invention, will be described in greater detail according to the preferred embodiments of the present invention in which.

DETAILED DESCRIPTION ACCORDING TO THE PREFERRED EMBODIMENTS OF THE PRESENT INVENTION

Figure 1:
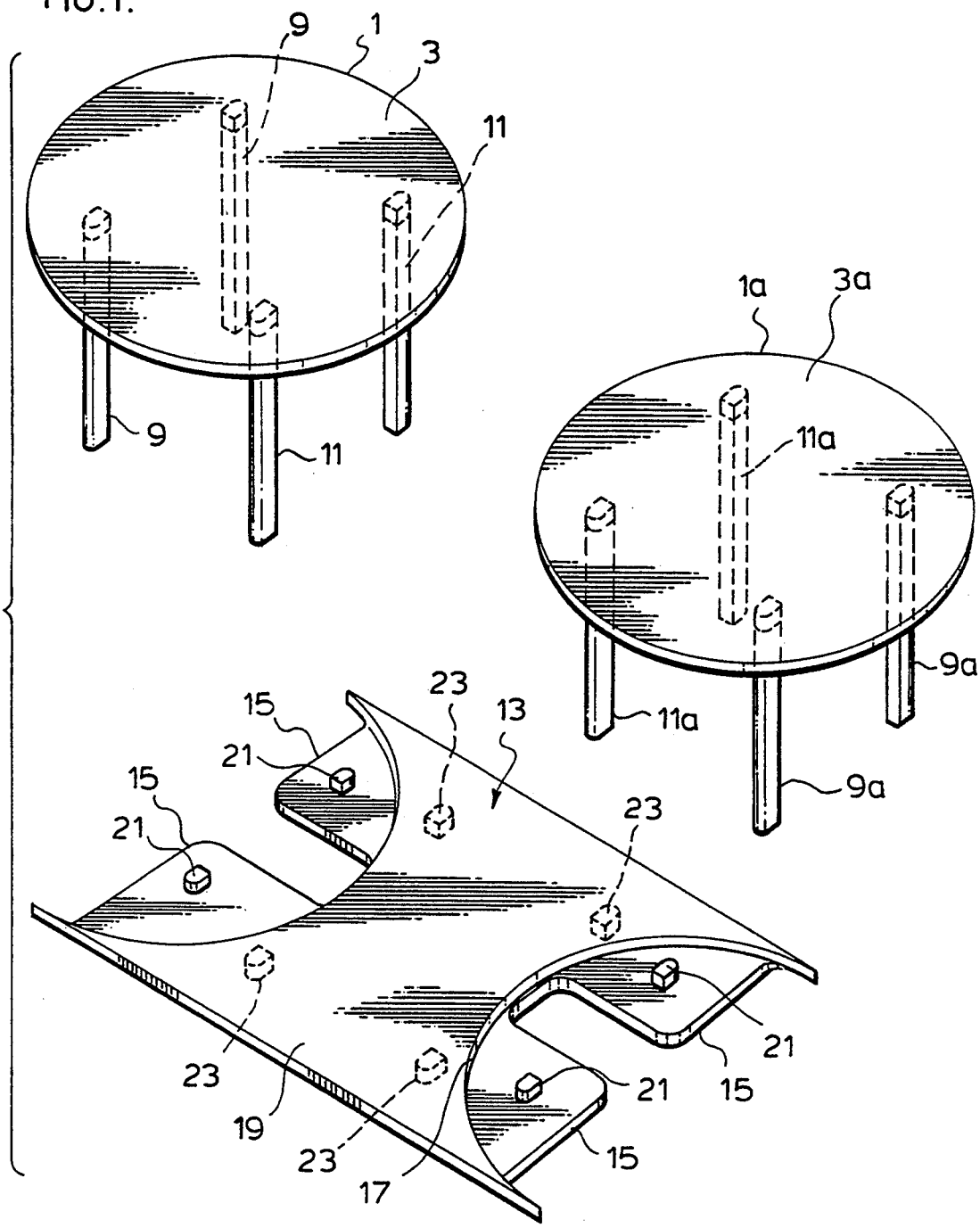
FIG. 1 is a perspective view looking down on a pair of tables to be connected by an insert made in accordance with a preferred embodiment of the present invention to form an extended table.

FIG. 1 shows a pair of tables 1 and 1*a*. These tables, which have identical components, are of a known construction currently available to the market place. In this particular embodiment as shown, both tables are for outdoor use and are made from vinyl or some similar resin material.

Figure 3:
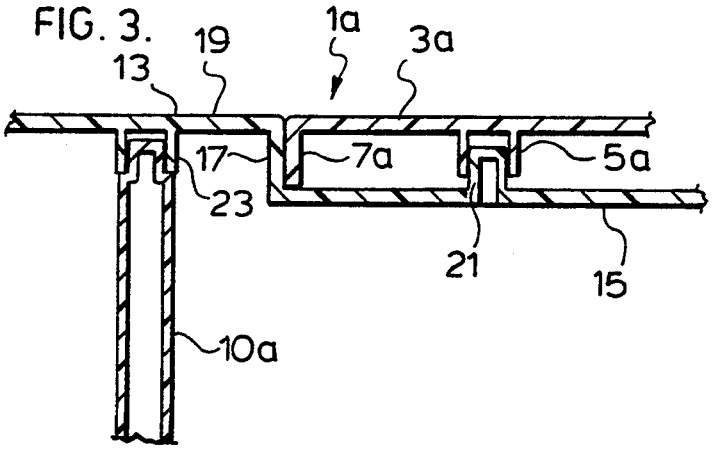
FIG. 3 is a sectional view along the lines AA of FIG. 2.

In the embodiment shown, each table includes a rounded table top, i.e. table top 3 on table 1 and table top 3*a* on table 1*a*. The underside of each table top is provided with four table leg pockets, such as pocket 5*a* on table 1*a* as shown in FIG. 3 of the drawings. Each pocket comprises a downwardly projecting hollow seat formed as an integral part of the table top for removably receiving a table leg fitted into each one of the pockets. Therefore, each of the tables has a knockdown construction where table 1 is fitted with a first pair of removeable legs 9 and a second pair of removeable legs 11. Table 1*a* includes a first pair of removeable legs 9*a* and a second pair of removeable legs 11*a*.

All of the legs noted above are identical in construction as are the pockets used to receive the legs. Different numerals have been used to identify the legs simply for clarity purposes in later describing an overall table assembly.

Each of the table tops further includes a downwardly turned peripheral lip. Lip 7*a* of table top 3*a* is shown in FIG. 3 of the drawings.

Figure 2:
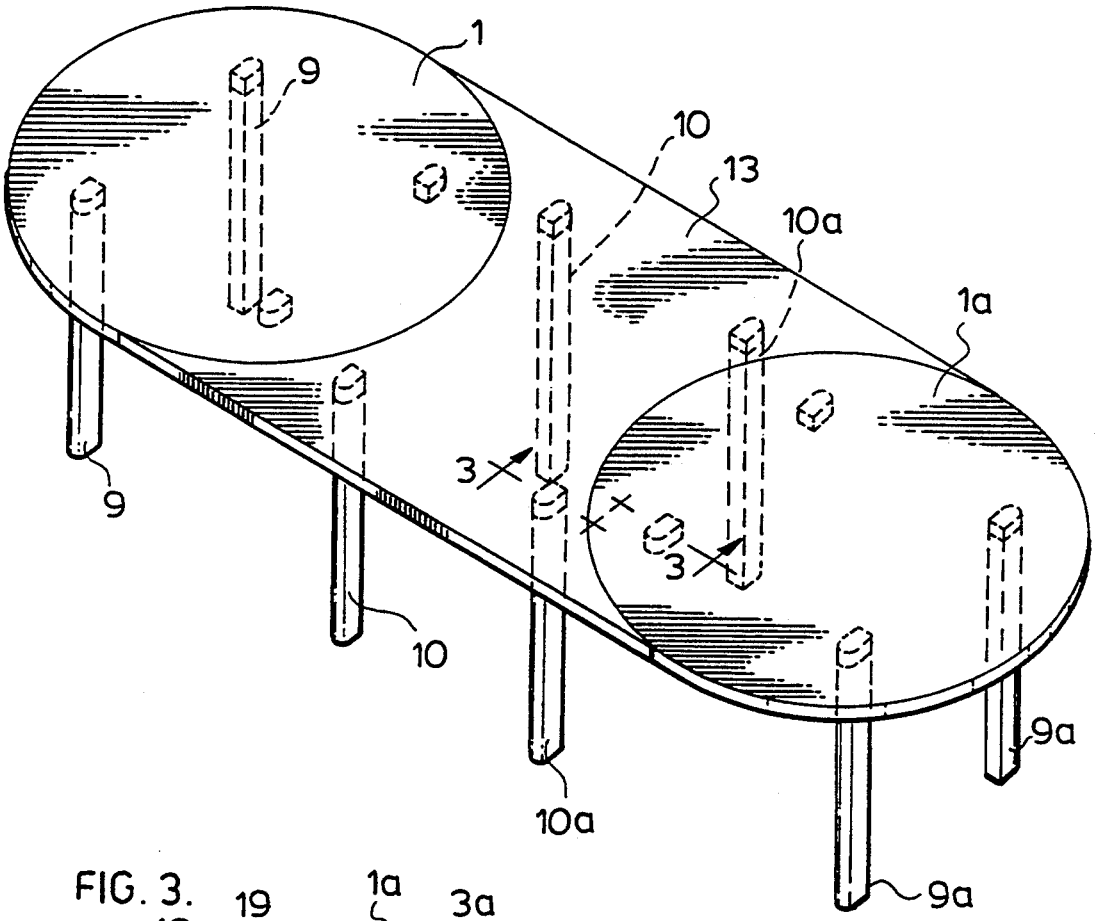
FIG. 2 is a further perspective view showing the components of FIG. 1 when an assembled position.

Each of the tables 1 and 1*a* is useable independently of one another as shown in FIG. 1 of the drawings. However, as shown in FIG. 2 of the drawings, these two tables also co-operate through a leaf or table extension generally indicated at 13 to form an extendable table assembly best seen in FIG. 2 of the drawings. The leaf itself is well shown in FIG. 1 of the drawings and a section through one end of the leaf is shown in FIG. 3 of the drawings.

Table leaf 13 is made from the same material as each of the tables. It, like the tables, has a flat top 19. It further includes a downwardly turned lip 17 which, as shown in FIG. 3, abuts with the table lip when the assembly is put together. FIGS. 1 and 2 show that the leaf is rounded or radiused along lip 17 to match the contour of the rounded table top. As shown in FIG. 2 of the drawings, when the leaf is inserted between the two tables it effectively forms one long oval table.

As best seen in FIGS. 1 and 3 of the drawings, a pair of horizontal platforms 15 extend outwardly from the lower end of lip 17 parallel to but vertically spaced below the top 19 of the leaf. Each of the platforms 15 is provided with an upwardly raised short post 21. Each of these posts is shaped and sized to frictionally fit within any one of the pockets such as, for example, pocket 5*a* on the bottom side of table 1*a*.

Located a short distance to the opposite side of lip 17 from platforms 15 and to the underside of the leaf are a pair of pockets 23 at each end of the leaf. Pockets 23 correspond in shape and size to the leg receiving pockets on the underside of each of the tables.

As noted above, each of the tables 1 and 1*a* is useable in an independent free standing mode as shown in FIG. 1. In order to join them together as one elongated extension table as shown in FIG. 2, the tables are aligned spaced from one another as shown in FIG. 1. In this position, the table legs on both sides of one of the tables align with the table legs on both sides of the other table. From here the inside pair of legs, i.e. the two pairs of legs closest to one another on each of the tables, are removed from their respective pockets. In the particular arrangement shown, legs 11 from table 1 are removed and legs 11*a* from table 1*a* are removed. This then exposes the leg pockets from which the legs have been removed and allows posts 21 on platforms 15 to be fitted up into these leg pockets as shown in FIG. 3. The method of securing the posts in the table pockets is once again through a frictional engagement, the same as that used to fit the table legs into the pockets. In the preferred embodiment, the shape of the posts matches the shape of the upper end of the table legs for fitting in the table pockets.

As also shown in FIG. 3 of the drawings, posts 21 on platforms 15 are set at a distance from the leaf lip so as to bring it into abutment with the lip on the table top.

The table legs, after being removed from the table, are inserted in the leaf pockets in the same manner that they were previously fitted into the table pockets. In FIG. 3, it will be seen that table leg 11*a* from table 1*a* is secured at its upper end in pocket 23 on the underside of leaf 13. The same is true with the other leg 11*a* to the opposite side of the leaf and, in addition, the two legs 11 from table 1 are also fitted into identical pockets on the underside of the table leaf. In this position, the table legs not only provide support for the leaf but in addition they provide support for each of the tables secured through the platforms at opposite ends of the leaf. It should be noted that the table legs have only been moved a very short distance from their original position beneath the tables which leaves space for people sitting at the table beneath the leaf as well as beneath each of the tables.

In the embodiment shown, there are two small platforms 15 provided at opposite ends of the leaf rather than using a single large platform. This not only reduces material costs in the leaf but in addition reduces the weight of the leaf and makes it easier to handle by the person fitting it between the two spaced apart tables.

In order to disassemble the elongated table of FIG. 2, the table legs are simply removed from the leaf, the leaf is removed at its opposite ends from the pockets in the two tables and the table legs are refitted into the table leg pockets.

As will be understood from the above, the entire construction does not use anything in the way of an elongated slider track typically of a metal or aluminum construction and, in the case of resin table, the entire assembly has a vinyl or other similar material construction. This substantially reduces the cost of the extension table as shown over conventional resin extension tables using, as noted above, aluminum tracks.

In addition, the length to which the table can be extended is not limited since they are not secured to one another by a track system. In contrast, the length to which the assembly can be extended is only limited by the length of the leave itself and this can be made as long or as short as desired.

From a cost saving standpoint, an extremely important feature of the present invention is that no additional legs need to be provided to support the leaf but rather the leaf uses the existing table legs which support both the leaf and the tables at opposite ends of the leaf.

From a set up standpoint, the table is extremely easy to assemble without the use of tools and mechanical fasteners etc.

It is to be appreciated that, although the drawings show a leaf specifically designed to interconnect a pair of round tables, other leaf and table shapes can also be connected using the system of the present invention.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An extendable resin table combination comprising first and second resin tables and a resin table extension matingly and removable fitted between said tables, each of said tables having first and second sets of undersurface leg pockets, said table extension including connectors fittable into said first set of leg pockets of each table which connects said table extension to said tables, said extension including third and fourth sets of leg pockets, said arrangement further including support legs releasably secured in said second set of leg pockets of said tables and also releasably secured in said third and fourth sets of leg pockets in said table extension, each of said tables having rounded table top edges and wherein said extension includes a center body part with a flat top and opposite end rounded edges mating with said rounded table top edges, said extension further including connector support portions bordered by said rounded edges of said extension and vertically below said table top, said connectors comprising posts extending upwardly from said support portions.

2. An extendable resin table as claimed in claim 1 wherein said support legs have an upper end configuration and wherein said posts have a shape matching said upper end configuration of said support legs.

3. An extendable resin table as claimed in claim 2 wherein any one of said connectors and any one of said support legs are interchangeably and releasably engageable in any one of said leg pockets.

* * * * *